US008250942B2

(12) United States Patent
Loritz

(10) Patent No.: US 8,250,942 B2
(45) Date of Patent: Aug. 28, 2012

(54) APPARATUS WITH ADJUSTABLE FREEDOM FROM BACKLASH FOR A CONTROL DEVICE

(75) Inventor: Steffen Loritz, Ulm (DE)

(73) Assignee: Robert Bosch GmbH, Stuttgart (DE)

( * ) Notice: Subject to any disclaimer, the term of this patent is extended or adjusted under 35 U.S.C. 154(b) by 366 days.

(21) Appl. No.: 12/564,704

(22) Filed: Sep. 22, 2009

(65) Prior Publication Data

US 2010/0077915 A1 Apr. 1, 2010

(30) Foreign Application Priority Data

Sep. 23, 2008 (DE) ..... 10 2008 048 507

(51) Int. Cl.
*G05G 1/00* (2008.04)

(52) U.S. Cl. ..... 74/470; 74/469

(58) Field of Classification Search ..... 74/469, 74/470, 480 R; 91/387
See application file for complete search history.

(56) References Cited

U.S. PATENT DOCUMENTS 4,756,157 A * 7/1988 Appel ..... 60/444
5,027,673 A * 7/1991 Behrens et al. ..... 74/473.1
7,171,887 B2 2/2007 Lilla

FOREIGN PATENT DOCUMENTS

DE 102 20 889 B3 2/2004

* cited by examiner

*Primary Examiner* — Justin Krause
(74) *Attorney, Agent, or Firm* — Muncy, Geissler, Olds & Lowe, PLLC

(57) ABSTRACT

An apparatus is provided for exerting on a regulating piston of a control device a regulating force that is a function of the position of an actuating lever. The apparatus comprises a bearing arrangement for supporting the actuating lever, a first arm and a second arm, each of which is rotatably mounted on the bearing arrangement independently of the others. The apparatus additionally includes a carrier element that is connected to the actuating lever, and an elastic element connecting the first arm and the second arm to one another. The apparatus is especially distinguished by the fact that the position of the carrier element relative to the first arm and to the second arm is adjustable to establish freedom from backlash.

8 Claims, 2 Drawing Sheets

APPARATUS WITH ADJUSTABLE FREEDOM FROM BACKLASH FOR A CONTROL DEVICE

This nonprovisional application claims priority under 35 U.S.C. §119(a) to German Patent Application No. 10 2008 048 507.1, which was filed in Germany on Sep. 23, 2008, and which is herein incorporated by reference.

BACKGROUND OF THE INVENTION

1. Field of the Invention

The invention relates to an apparatus with adjustable freedom from backlash for a control device.

2. Description of the Background Art

Known from DE 102 20 889 B3, which corresponds to U.S. Pat. No. 7,171,887 is an adjusting device for hydrostatic piston machines. The adjusting device comprises an actuating piston which can be moved between two end positions and which can be subjected to actuating pressures acting on it in opposite directions. The actuating pressures can be regulated by an actuating pressure regulating valve serving as a control device. To this end, the actuating pressure regulating valve has a deflectable regulating piston to which is applied a regulating force that is a function of the position of the actuating piston. The regulating force is directed opposite to a control force acting on the regulating piston, and is zero in a rest position of the adjusting device. In the rest position of the adjusting device, the regulating piston is in its neutral position, and the actuating piston is in a position determined by the control of the valve. To produce the regulating force, an actuating lever, which is rotatably mounted on a bearing pin, is located in the actuating pressure regulating valve. The regulating force is a function of the angular position of the actuating lever. Also rotatably mounted on the bearing pin are a first arm and a second arm. The first and second arms are connected to one another by a tension spring, so that excursion of one of the two arms relative to the other arm causes stretching of the tension spring. A carrier pin is located at one end of the actuating lever. During a rotation of the actuating lever about the bearing pin, the carrier pin rests against one of the arms. Under tension of the spring, the other arm bears against a support provided on the regulating piston, thus applying the regulating force to the support.

SUMMARY OF THE INVENTION

It is therefore an object of the present invention to create an apparatus for exerting on a regulating piston of a control device a regulating force that is a function of the position of an actuating lever, with which apparatus a zero position can be achieved reliably.

According to an embodiment, the apparatus for exerting on a regulating piston of a control device a regulating force that is a function of the position of an actuating lever comprises a bearing arrangement for supporting the actuating lever, a first arm and a second arm, each of which is rotatably mounted on the bearing arrangement independently of the others. In addition, the apparatus includes a carrier element that is connected to the actuating lever, and an elastic element connecting the first and second arms to one another. The position of the carrier element relative to the first and second arms is adjustable to establish backlash-free contact with the arms in the rest position. The intent is to ensure simultaneous, backlash-free contact of the carrier element with the first and second arms. In this way, systematic and/or statistical component tolerances can be compensated, thereby reliably achieving a zero position. The components are each designed such that the freedom from backlash can easily be adjusted from outside both before and after operation. This permits readjustment when made necessary by wear. Failures resulting from a lack of adjustability of the zero position on the production test stand can be avoided entirely.

In an example embodiment, the first arm forms a first surface and the second arm forms a second surface, wherein the first surface and the second surface enclose an acute angle. As a result, adjusting the relative position of the carrier element makes it possible for the surfaces to be touched simultaneously by the carrier element. In this way, the compensation of component tolerances for reliably achieving a zero position through adjustment or readjustment of freedom from backlash is greatly simplified.

The position of the carrier element can be adjustable relative to the actuating lever. In this way, it is simple to adjust the position of the carrier element relative to the first arm and to the second arm. As a result, simultaneous, backlash-free contact by the carrier element with the first and second arms can be realized in a simplified manner.

The carrier element can be displaceable and/or rotatable with respect to the actuating lever. As a result, the position of the carrier element relative to the actuating lever can be easily adjusted as needed.

The connection between the carrier element and the actuating lever can contain a force-locking stop and/or an interlocking stop. This makes it possible to fix a position of the carrier element relative to the first and second arms. Threads and nuts may be used, for example.

The carrier element can also have a conical region. This ensures that a position of the carrier element relative to the first and second arms permits the desired freedom from backlash. With this design, the relative position can be adjusted by changing the penetration depth of the conical section between the two surfaces of the arms.

In an embodiment, the position of the actuating lever can be adjustable relative to the axis of rotation of the arms in order to adjust the freedom from backlash. In this way, the position of the carrier element relative to the first and second arms can be adjusted through the position of the actuating lever. In addition, it is possible to combine an adjustment in the position of the carrier element relative to the actuating lever with the adjustment of the position of the actuating lever relative to the bearing arrangement. In this way, more degrees of freedom are provided for the adjustment of the freedom from backlash, and in addition, greater component tolerances can be compensated.

In an embodiment, the position of the first and second arms is adjustable relative to the axis of rotation of the actuating lever in order to adjust the freedom from backlash.

The bearing arrangement can have a first eccentric pin whose position can be adjusted independently, with only the actuating lever being rotatably mounted on the pin. As a result, the position of the actuating lever's axis of rotation relative to the bearing arrangement can be easily adjusted by rotating the eccentric pin.

Further, the bearing arrangement can additionally have a second eccentric pin whose position can be adjusted independently, with the first arm and the second arm each being mounted thereon such that they can each rotate independently. As a result, the position of the axis of rotation of the first and second arms relative to the bearing arrangement can be changed. In this way, the position of the carrier element relative to the first and second arms can be changed in order to adjust the freedom from backlash.

The position of the carrier element relative to the first and second arms can be adjusted by the changing the position of the carrier element relative to the actuating lever and/or the position of the actuating lever relative to the bearing arrangement and/or the position of the first arm and/or the position of the second arm relative to the bearing arrangement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
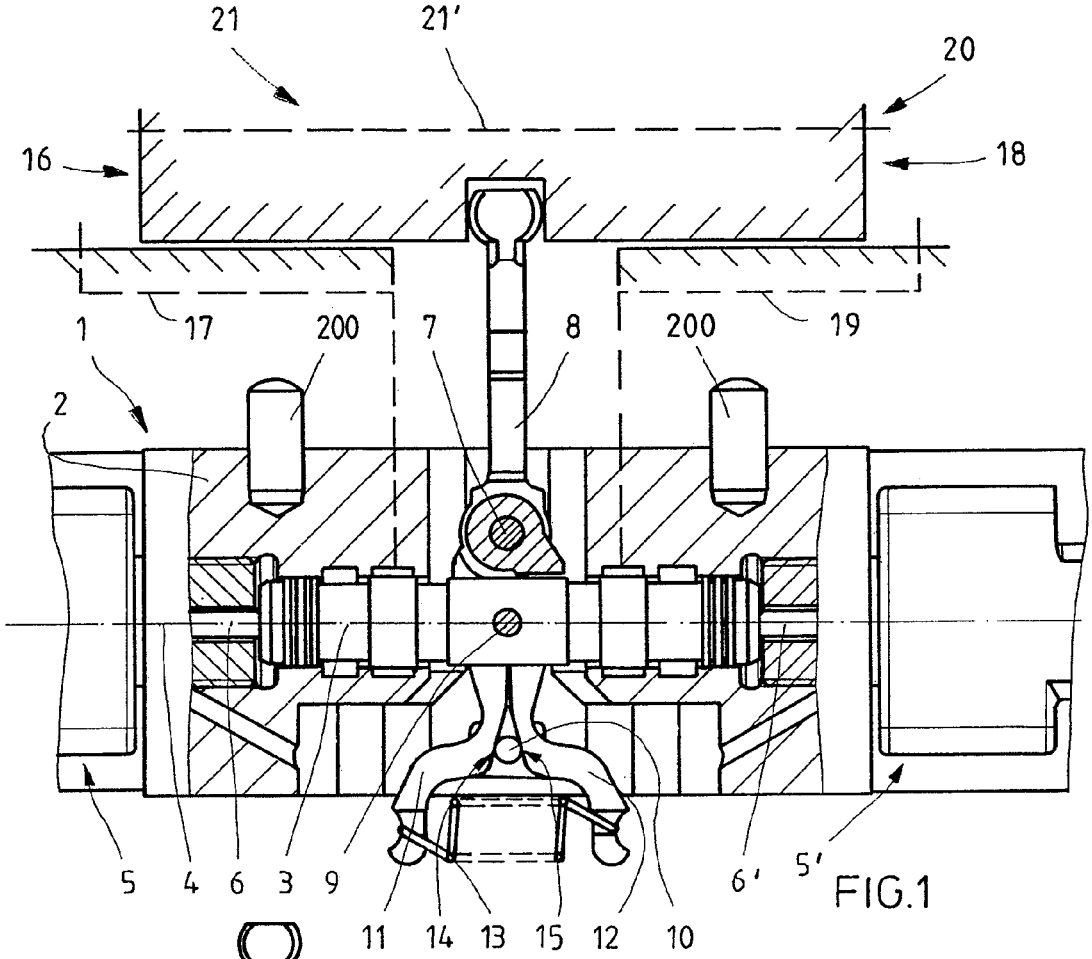
FIG. 1 shows an apparatus for exerting on a regulating piston of a control device a regulating force that is a function of the position of an actuating lever, according to an embodiment of the invention.

FIG. 1 shows an actuating pressure regulating valve 1 of a control device, which is mechanically and hydraulically connected to an adjusting device 20. The actuating pressure regulating valve 1 comprises a housing 2 in which is located a regulating piston 3, which is axially displaceable between a first electromagnet 5 and a second electromagnet 5' along a regulating piston axis 4. The regulating piston 3 can be subjected to a control force by the first electromagnet 5 through a first tappet 6 and by the second electromagnet 5' through a second tappet 6'.

The first electromagnet 5 and the second electromagnet 5' can subject the regulating piston 3 to forces in opposite directions and move it. A bearing arrangement 7 is formed in the actuating pressure regulating valve 1. Mounted on the bearing arrangement 7 are an actuating lever 8 that is connected to a carrier element 10, a first arm 11 and a second arm 12, each of which is mounted to rotate independently of the others. The first arm 11 and the second arm 12 are connected to one another by a tension spring 13, and can each apply a force to a guide pin 9, which is connected to the regulating piston 3, hence also applying the force to the regulating piston 3. The first arm 11 forms a first surface 14, and the second arm 12 forms a second surface 15. The first surface 14 and the second surface 15 are arranged here such that simultaneous, backlash-free contact by the carrier element 10 with the first arm 11 and the second arm 12 is made possible by changing the position of the carrier element relative to the surfaces 14, 15.

In FIG. 1, the carrier 10 is simultaneously touching the first surface 14 and the second surface 15 without backlash. A rotation of the actuating lever 8 about its axis of rotation defined by the bearing arrangement 7 results immediately in a movement of the carrier element 10, which bears against the first surface 14 or against the second surface 15, and applies a force to the applicable first arm 11 or second arm 12. The tension spring 13 transmits a pulling force to the arm 12 or 11 that is not subjected to force, so that this arm is pulled in the direction of the arm 11, 12 that is subjected to force. The pulled arm 12, 11 then exerts an additional regulating force on the guide pin 9 as a support. Through the action of a first force by the first electromagnet 5 and/or of a second force by the second electromagnet 5' and/or the additional force by the guide pin 9, the regulating piston 3 can be carried and displaced axially along the regulating piston axis 4. As a function of the position of the regulating piston 3 in the housing 2, pressure medium is delivered through a first actuating pressure line 17 into a first actuating pressure chamber 16 of the adjusting device 20, or is delivered through a second actuating pressure line 19 into a second actuating pressure chamber 18 of the adjusting device 20.

The position of an actuating piston 21 of the adjusting device 20 is changed or held constant in accordance with the pressures in the first actuating pressure chamber 16 and the second actuating pressure chamber 18. The actuating piston 21 can be displaced along an actuating piston axis 21' that extends parallel to the regulating piston axis 4. The position of the actuating lever 8 is determined by the position of the actuating piston 21. A change in the position of the actuating piston 21 results in a change in the position of the actuating lever 8, and thus in a change in the resulting force on the actuating lever. Located in the housing 2 are fastening elements 200, by means of which the actuating pressure regulating valve 1 can be connected to the adjusting device 20.

Figure 2:
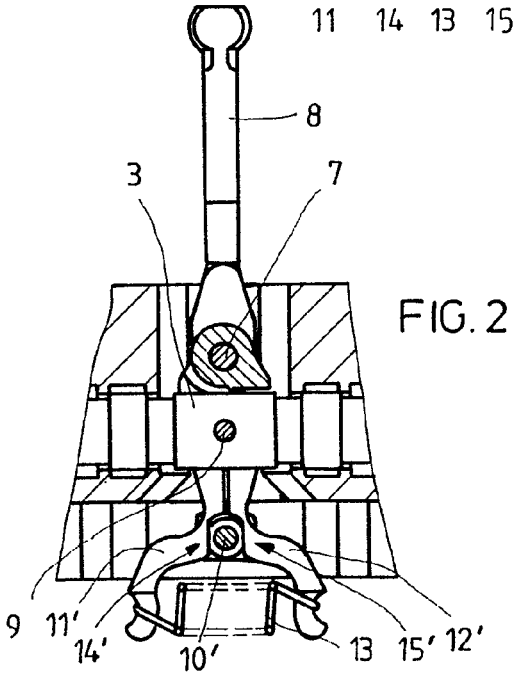
FIG. 2 shows a section of an apparatus for exerting on a regulating piston of a control device a regulating force that is a function of the position of an actuating lever, according to another embodiment of the invention.

FIG. 2 shows an inventive apparatus that derives from the apparatus shown in FIG. 1. The actuating lever 8, an alternative first arm 11', and an alternative second arm 12' are each rotatably mounted on the bearing arrangement 7 independently from one another. The actuating lever 8 is connected to an alternative carrier pin 10'. The alternative carrier pin 10' has a conically designed region, which simultaneously touches an alternative first surface 14' of the alternative first arm 11' and an alternative second surface 15' of the alternative second arm 12' without backlash. The first alternative arm 11' and the second alternative arm 12' are connected to one another by the tension spring 13. The functions of the alternative components correspond to the above-described functions of the components that they replace. Other components with reference symbols already introduced correspond to the components with these reference symbols that have already been introduced. The distance from the conical region to the axis of rotation of the actuating lever 8 is fixed. However, the conical region can be moved in the direction of its axis, which is to say into or out of the plane of the drawing. The cone thus penetrates different distances into the intermediate space between the first and second surfaces.

Figure 3:
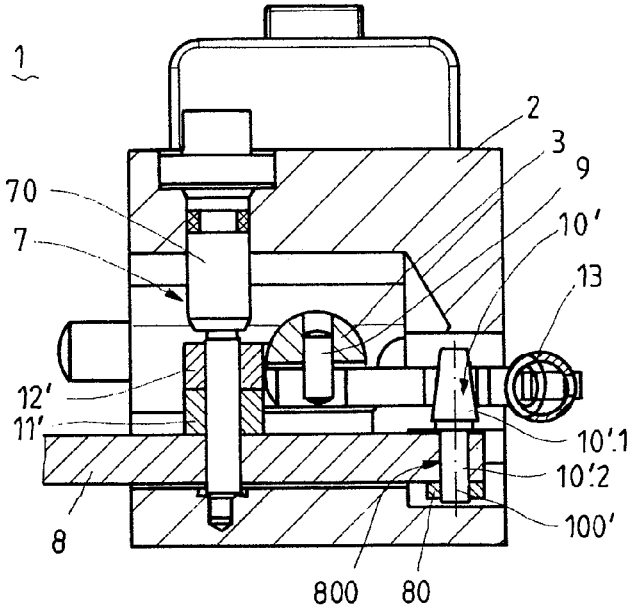
FIG. 3 shows a section through the actuating pressure regulating valve from FIG. 2.

FIG. 3 shows a section through the actuating pressure regulating valve 1 from FIG. 2. The bearing arrangement 7 is formed in the housing 2 of the actuating pressure regulating valve 1. The bearing arrangement 7 comprises a one-piece eccentric pin 70. The actuating lever 8, the alternative first arm 11', and the alternative second arm 12' are each mounted on the eccentric intermediate part of the eccentric pin 70 to rotate about a common axis of rotation independently of one another. The alternative first arm 11' and the alternative second arm 12' are connected to one another by the tension spring 13. The guide pin 9 is connected to the regulating piston 3 and can be subjected to a force by the alternative first arm 11' or the alternative second arm 12'.

The alternative carrier pin 10' has a conical upper section 10'.1 and a cylindrical lower section 10'.2. The conical upper section 10'.1 and the cylindrical lower section 10'.2 are arranged coaxially and immediately adjacent to one another, forming a common pin axis 100. The cylindrical lower section 10'.2 has a thread that is designed to be complementary to a cylindrical bore 800 in the actuating lever 8. The alternative carrier pin 10' can be displaced in its position relative to the actuating lever. To this end, the alternative carrier pin 10' can be rotated and its axial position can be adjusted. In this way, the conical upper section 10'.1 can be brought into simultaneous backlash-free contact with the alternative first arm 11' and the alternative second arm 12'. In order to hold constant (or fix) the connection between the actuating lever 8 and the alternative carrier pin 10' or a position of the alternative carrier pin 10' relative to the actuating lever 8, a nut 80 is provided which locks the carrier pin 10'.

Figure 4:
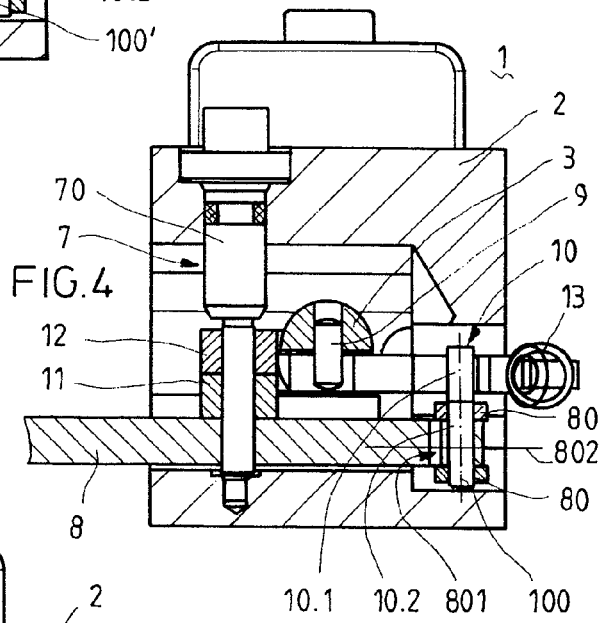
FIG. 4 shows a section through the actuating pressure regulating valve from FIG. 1.

FIG. 4 shows a section through the actuating pressure regulating valve 1 from FIG. 1. Components with reference symbols already introduced correspond to the components with these reference symbols that have already been introduced. In place of the alternative first arm 11' and the alternative second arm 12', the first arm 11 and the second arm 12 are supported independently of one another on an eccentric intermediate section of the bearing arrangement 7. Provided in place of the alternative carrier pin 10' is the carrier pin 10, which is connected to the actuating lever 8 by clamping. The carrier pin 10 is arranged in a recess 801 with an adjustment clearance. The carrier pin 10 is divided into a cylindrical upper pin section 10.1 and a cylindrical lower pin section 10.2. The upper pin section 10.1 and the lower pin section 10.2 are arranged coaxially to the common pin axis 100 and immediately adjacent to one another. The carrier pin 10, or more precisely the lower pin section 10.2, is displaceable in the recess 801 along an actuating lever axis 802 that is perpendicular to the pin axis 100. By this means, a backlash-free, simultaneous contact with the first arm 11 and the second arm 12 is easily adjustable, since their surfaces 14, 15 enclose an acute angle with one another. In order to fix the connection between the actuating lever 8 and the carrier pin 10 or a position of the carrier pin 10 relative to the actuating lever 8, two nuts 80 are provided on the carrier pin 10 for locking.

Figure 5:
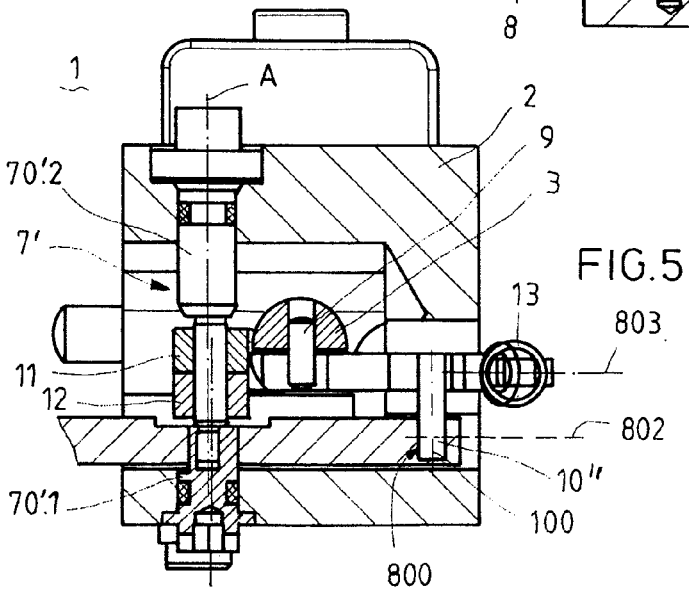
FIG. 5 shows a section through an alternative actuating pressure regulating valve.

FIG. 5 shows a section through the actuating pressure regulating valve 1 from a third example embodiment. As above, components with reference symbols already introduced correspond to the components with these reference symbols that have already been introduced. An alternative bearing arrangement 7' comprises a first eccentric pin 70'.1 and a second eccentric pin 70'.2. The two eccentric pins 70'.2 and 70'.1 are rotatable about the same axis A. In this context, a central end peg of the eccentric pin 70'.2 extends into a central bore of the eccentric pin 70'.1. The actuating lever 8 is rotatably mounted on the first eccentric pin 70'.1 so that its axis of rotation is adjustable with regard to its distance from the guide pin 9. The first arm 11 and the second arm 12 are each mounted on an eccentric intermediate part of the second eccentric pin 70'.2 to rotate independently of one another and independently of the actuating lever 8. Their axis of rotation can thus be adjusted together but independently of the axis of rotation of the actuating lever 8. By rotating the first eccentric pin 70'.1 about an axis A parallel to the pin axis 100, the actuating lever 8 can be displaced along the longitudinal axis 803 of the actuating lever and perpendicular to the pin axis 100. By this means, a cylindrical additional alternative carrier pin 10", which is located in the cylindrical bore 800, can also be displaced along the actuating lever axis 802. In this way, a backlash-free, simultaneous contact with the first arm 11 and the second arm 12 is easily adjustable, by means of the additional alternative carrier pin 10", these arms again enclosing an acute angle with one another. The second eccentric pin 70'.2 can likewise rotate about the axis A parallel to the pin axis 100. The first eccentric pin 70'.1 and the second eccentric pin 70'.2 can each rotate independently of one another. By this means, the first arm 11 and the second arm 12 can be displaced simultaneously in a direction parallel to the actuating lever axis 802, likewise perpendicular to the pin axis 100. By this means, adjusting a backlash-free, simultaneous contact of the first arm 11 and the second arm 12 with the additional alternative carrier pin 10" is likewise simplified. The axes of symmetry of individual rotationally symmetric regions of the eccentric pins 70'.1 and 70'.2 are arranged parallel to one another.

The invention is not limited to the example embodiments shown. Rather, individual features of the example embodiments can also be combined with one another to advantage.

For example, in the example embodiment from FIG. 5, it is possible to replace the alternative bearing arrangement 7' with the bearing arrangement 7 and/or to replace the first arm 11 and the second arm 12 with the alternative first arm 11' and the alternative second arm 12' and/or to replace the cylindrical bore 800 with the recess 801 having adjustment clearance and/or to replace the additional alternative carrier pin 10" with the carrier pin 10 or the alternative carrier pin 10'.

Furthermore, in the example embodiment from FIG. 4, it is also possible to replace the bearing arrangement 7 with the alternative bearing arrangement 7' and/or to replace the first arm 11 and the second arm 12 with the alternative first arm 11' and the alternative second arm 12' and/or to replace the prism-shaped recess 801 with the cylindrical bore 800 and/or to replace the carrier pin 10 with the additional alternative carrier pin 10" or the alternative carrier pin 10'.

Moreover, the first surface 14 and the second surface 15 (FIG. 1) or the first alternative surface 14' and the second alternative surface 15' (FIG. 2) can each be flat and can together form a first angle with respect to a first axis of rotation and/or form a second angle with respect to a second axis of rotation such that the first surface 14 and the second surface 15 or the first alternative surface 14' and the second alternative surface 15' can more easily be simultaneously contacted by a carrier element that is used. Alternatively, it is possible to use surfaces that are not flat and that are matched to the geometry of a carrier pin that is used, which has a different geometry than that shown in the example embodiments presented.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for exerting, on a regulating piston of a control device, a regulating force that is a function of a position of an actuating lever, the apparatus comprising:

a bearing arrangement configured to support the actuating lever, a first arm, and a second arm, each of which is rotatably mounted on the bearing arrangement independently from one another;

a carrier element connectable to the actuating lever; and an elastic element connecting the first arm and the second arm to one another, wherein the position of the carrier element relative to the first arm and to the second arm is adjustable to establish backlash-free contact of the carrier element with the arms in a rest position of the apparatus, and wherein the position of the carrier element is adjustable relative to the actuating lever.

2. The control device according to claim 1, wherein the first arm forms a first surface and the second arm forms a second surface, and wherein the first surface and the second surface together enclose an acute angle.

3. The control device according to claim 1, wherein the carrier element has a conical region.

4. The control device according to claim 1, wherein the position of the actuating lever is adjustable relative to an axis of rotation of the arms in order to adjust freedom from backlash.

5. The control device according to claim 1, wherein the position of the first arm and of the second arm is adjustable relative to an axis of rotation of the actuating lever in order to adjust freedom from backlash.

6. An apparatus for exerting, on a regulating piston of a control device, a regulating force that is a function of a position of an actuating lever, the apparatus comprising:

a bearing arrangement configured to support the actuating lever, a first arm, and a second arm, each of which is rotatably mounted on the bearing arrangement independently from one another;

a carrier element connectable to the actuating lever; and an elastic element connecting the first arm and the second arm to one another, wherein the position of the carrier element relative to the first arm and to the second arm is adjustable to establish backlash-free contact of the carrier element with the arms in a rest position of the apparatus, and wherein the bearing arrangement has a first eccentric pin, whose position is adjustable independently, and wherein the actuating lever is rotatably mounted on the pin.

7. The control device according to claim 6, wherein the bearing arrangement has a second eccentric pin, whose position is adjustable independently, and wherein the first arm and the second arm are mounted thereon such that they can each rotate independently.

8. An apparatus for exerting, on a regulating piston of a control device, a regulating force that is a function of a position of an actuating lever, the apparatus comprising:

a bearing arrangement configured to support the actuating lever, a first arm, and a second arm, each of which is rotatably mounted on the bearing arrangement independently from one another;

a carrier element connectable to the actuating lever; and an elastic element connecting the first arm and the second arm to one another, wherein the position of the carrier element relative to the first arm and to the second arm is adjustable to establish backlash-free contact of the carrier element with the arms in a rest position of the apparatus, and wherein the carrier element is displaceable and or rotatable with respect to the actuating lever.

* * * * *